United States Patent [19]

Pelton

[11] 4,133,259

[45] Jan. 9, 1979

[54] REFUSE PELLETIZER

[75] Inventor: John F. Pelton, Yorktown Heights, N.Y.

[73] Assignee: Union Carbide Corporation, New York, N.Y.

[21] Appl. No.: 876,697

[22] Filed: Feb. 10, 1978

Related U.S. Application Data

[63] Continuation-in-part of Ser. No. 690,281, May 26, 1976, Pat. No. 4,100,849, and Ser. No. 675,934, Apr. 12, 1976, abandoned.

[51] Int. Cl.[2] ..... B30B 15/26

[52] U.S. Cl. ..... 100/43; 100/98 R; 100/127; 100/209; 100/215; 110/109

[58] Field of Search ..... 100/43, 127, 137, 98 R, 100/138, 141, 142, 143, 179, 185, 192, 209, 215, DIG. 5, DIG. 8; 110/109, 116; 214/23, 17 B

[56] References Cited

U.S. PATENT DOCUMENTS

| | | | |
|---|---|---|---|
| 751,752 | 2/1904 | Pilliod | 100/185 X |
| 2,296,516 | 9/1942 | Goss | 100/DIG. 8 |
| 2,984,173 | 5/1961 | Roche | 100/185 X |
| 3,021,254 | 2/1962 | Helversen | 100/127 X |
| 3,044,391 | 7/1962 | Pellett | 100/DIG. 8 |
| 3,179,040 | 4/1965 | Seltzer | 100/192 X |
| 3,621,774 | 11/1971 | Dedio | 100/179 |

FOREIGN PATENT DOCUMENTS

| | | | |
|---|---|---|---|
| 1122892 | 1/1962 | Fed. Rep. of Germany | 100/209 |
| 7147538 | 4/1972 | Fed. Rep. of Germany | 100/43 |
| 2156733 | 5/1973 | Fed. Rep. of Germany | 100/DIG. 8 |
| 885461 | 9/1943 | France | 100/209 |
| 202643 | 8/1923 | United Kingdom | 100/DIG. 8 |
| 875441 | 8/1961 | United Kingdom | 100/DIG. 8 |
| 1140407 | 1/1969 | United Kingdom | 100/43 |
| 176137 | 3/1966 | U.S.S.R. | 100/209 |

*Primary Examiner*—Billy J. Wilhite

*Attorney, Agent, or Firm*—Lawrence G. Kastriner

[57] ABSTRACT

Apparatus capable of producing pellets of compacted refuse having a density of at least 20 lbs./ft.$^3$ comprising:

(1) a cylindrical tube having a compacted chamber whose length is shorter than the shortest "critical length" for the refuse to be pelletized, with a feed port in the side wall of the tube and a discharge port at the end of the tube, (2) a feed hopper communicating with the inlet port of the tube, (3) a reciprocating ram in the inlet end of the tube capable of exerting a pressure of at least 200 psi on each forward stroke, and (4) a refuse flow restrictor in the tube in which the degree of restriction is controlled in response to changes in the ram pressure required to advance the compacted refuse down the tube.

10 Claims, 12 Drawing Figures

FIG. 11
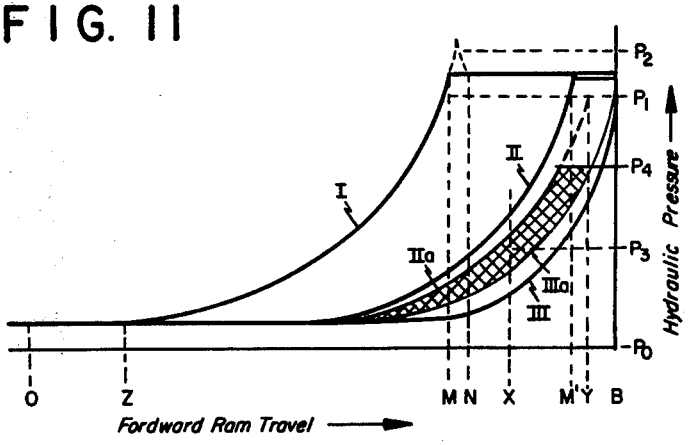
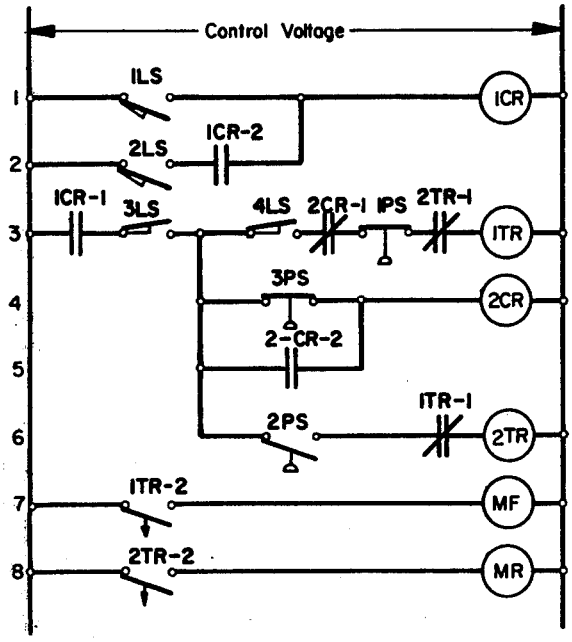
FIG. 12

REFUSE PELLETIZER

BACKGROUND

This application is a continuation-in-part of U.S. application Ser. No. 675,934 filed Apr. 12, 1976, now abandoned and of my copending U.S. application Ser. No. 690,281 filed May 26, 1976 now U.S. Pat. No. 4,100,849.

This invention relates in general, to apparatus for pelletizing solid waste, and more specifically to a device which is capable of compacting shredded refuse and the like to such an extent as to form a coherent pellet which remains intact as it is pyrolyzed in a vertical shaft furnace.

During the past several years considerable effort has gone into developing new technology for disposing of solid refuse in an environmentally acceptable manner and at the same time recovering, insofar as possible, the useful resources contained therein. One such process is described in U.S. Pat. No. 3,729,298 wherein solid refuse is fed directly into a vertical shaft furnace in which the combustible portion of the refuse is pyrolized — principally to a fuel gas consisting of carbon monoxide and hydrogen — and in which the uncombustible portion of the refuse is fluidized to molten metal and slag.

An improvement on the process described in the above mentioned U.S. patent is described and claimed by J. E. Anderson in U.S. Pat. No. 4,042,345. This process requires that the refuse be compacted into pellets that are sufficiently strong to remain intact as they move down through the drying and pyrolysis zones of the furnace. Anderson has found that in order to have a refuse pellet which is sufficiently strong to remain coherent, i.e. intact, his process requires that it have a density greater than that given by the equation:

$$D = 2000/(100-0.8A)$$

where:

D = the density of the pellet (lbs./ft.$^3$)

A = percent inorganics in the refuse pellet.

Anderson has also discovered that if the refuse pellets are sufficiently dense to have the necessary structural strength, then the drying and pyrolysis reactions become limited by the rate of heat transfer and diffusion within the pellets, and that in order to obtain a satisfactory process, the ratio of the surface area to the volume of the pellets should be greater than that given by the equation:

$$R = 15\,(G/H)^{0.625}$$

where:

R = the surface to volume ratio (ft.$^2$/ft.$^3$)

H = the height of the refuse bed in the furnace (ft.)

G = the refuse feed rate (tons/day/ft.$^2$ of furnace cross-sectional area).

OBJECTS

It is an object of the present invention to provide apparatus capable of compacting refuse into individual pellets which have sufficient strength to remain intact while being consumed in a shaft furnace or similar device.

It is another object of this invention to provide a compacting pelletizer which is capable of feeding coherent refuse pellets into a furnace at a controllable rate and in such manner as to prevent the escape of flammable and toxic gases from the furnace through its feed inlet port.

It is still another object of this invention to provide a device for compacting shredded refuse into coherent pellets of a suitable size and with such density and strength as to remain substantially intact while being converted in a shaft furnace to a useful gas and a fluid inorganic slag or residue.

SUMMARY OF THE INVENTION

The above and other objects which will become apparent to those skilled in the art from the detailed disclosure and claims to follow are achieved by the present invention which comprises:

apparatus capable of producing pellets of compacted refuse having a density of at least 20 lbs./ft.$^3$ comprising:

(1) a cylindrical tube, having a compacted chamber whose length is shorter than the shortest critical length for the refuse to be pelletized, said tube being provided near the inlet end thereof with a feed port in the side wall of the tube, the opposite end of said tube constituting the discharge port, (2) a feed hopper for the refuse to be compacted having an outlet port communicating with the inlet port of said tube, (3) a reciprocating driven ram located in the inlet end of said tube and axially aligned therewith, the perimeter of said ram being in sliding contact with the inner surface of said tube, and capable of exerting a pressure of at least 200 psi on each forward stroke of the ram, and (4) means for restricting the flow of refuse through said tube, such that the degree (i.e. the amount) of restriction is variable in response to changes in the force required to advance the column of compacted refuse in the tube.

Preferably, said apparatus also comprises:

(5) means for closing the tube feed port in sequenced timing with said reciprocating ram, such that the tube feed port is open when the ram is in its retracted position and closed while the ram is moving forward past the tube feed port.

The preferred structure of said restricting means comprises a plurality of axially elongated leaves, each of which constitutes a flush section of tube wall, flexibly attached at its upstream end to the tube, movable radially inward or outward of the tube axis at its downstream end, and having edge surfaces parallel to each other.

A preferred embodiment of the invention comprises two parallel cylindrical tubes whose respective feed ports communicate with a single feed hopper, wherein the respective rams within each tube operate in tandem, such that when one is retracted the other is extended. It is also preferred that the means for closing the feed ports constitutes a power driven rotating vane, located in the base of the hopper which is operable in timed sequence with each of the reciprocating rams. Means for dewatering the refuse, located in the downstream portion of the tube are also preferred, as is the provision of a gas-tight housing to enclose the restrictors and the dewatering means, thereby rendering the pelletizer capable of feeding pellets directly to a refuse disposal furnace in a gas-tight manner.

THE DRAWINGS

FIG. 11 is a graph illustrating the relationship between ram pressure and ram travel for different refuse loadings.

FIG. 12 illustrates a preferred electrical circuit for automatically controlling the position of the mechanical restrictors in response to changes in the ram pressure.

DETAILED DESCRIPTION

Figure 1:
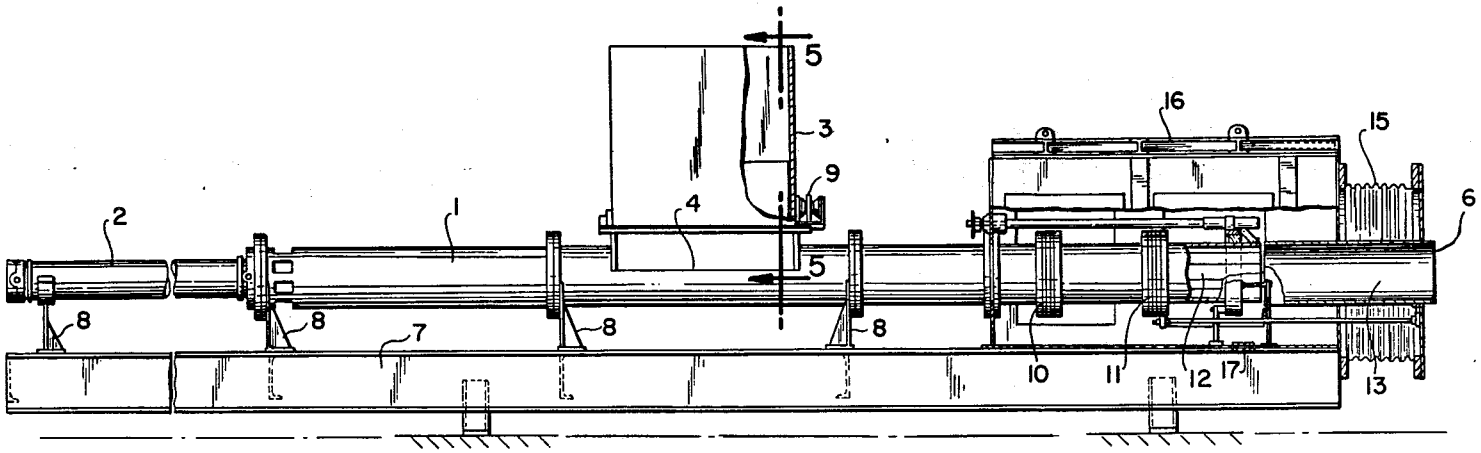
FIG. 1 is a side view in partial cross-section illustrating the preferred double barreled embodiment of the apparatus which constitutes the present invention.
Figure 2:
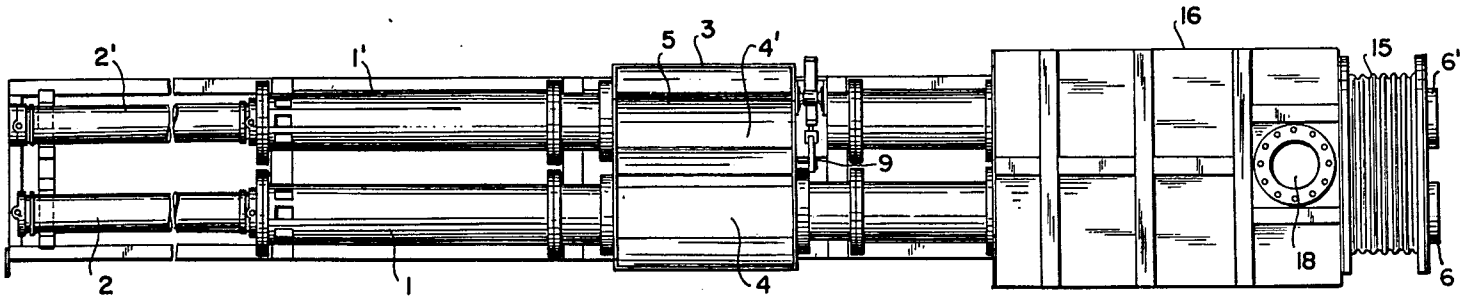
FIG. 2 is a top view of FIG. 1.

FIGS. 1 and 2 disclose in side and top views, respectively, the double barreled pelletizing refuse feeder which constitutes the preferred embodiment of the present invention. The apparatus consists of two identical parallel cylindrical tubes 1 and 1' into which refuse is fed from a common hopper 3 through feed inlet ports 4 and 4' located in the tops of the respective tubes 1 and 1'. The refuse is directed into the tubes and contained therein with the aid of a rotating vane 5 (more clearly seen in FIG. 5). Tubes 1 and 1' are most conveniently constructed from a plurality of flanged sections of steel tubing conventionally bolted together. The flanged back end of tubes 1 and 1' are bolted to hydraulic cylinders 2 and 2' which drive rams (not shown) axially aligned within the feed ends of each tube. The perimeter of each ram is in sliding contact with the inner surface of each tube. Each ram is capable of exerting a pressure in excess of 1000 psi upon the refuse in the tube thereby being capable of compressing the refuse to a density of at least 20 lbs./ft.$^3$ and of pushing the compacted refuse through the tube and out the discharge ports 6 and 6'. The pelletizer apparatus rests upon a base frame 7 to which the pelletizer is firmly secured through a plurality of supports 8. The rotating vane 5 is driven by means of a conventional drive means 9. Means for dewatering the refuse 10 and 11 are located near the downstream end of the tubes. The upper portion of these are shown in greater detail in FIG. 3. The variable restrictor assembly 12, which constitutes a section of each of the tubes 1 and 1', is disclosed in greater detail in FIGS. 6 and 7. The discharge end of the restrictor assembly 12 communicates with the discharge conduit 13 the diameter of which is wider than that of tube 1.

In order to provide a vapor tight seal between the pelletizer and a furnace, a flexible sleeve 15 surrounds tubes 1 and 1', connecting the feed port of a furnace and the housing 16 which surrounds the forward end of the pelletizer. Restrictor assembly 12 as well as the dewatering means 10 and 11 are located inside of the vapor tight housing 16 in order to prevent gases from escaping to the atmosphere. Housing 16 is provided with a drainage plug 17 through which any accumulation of liquid may be either periodically discharged through a suitable valve, or continuously discharged through a suitable water leg. For purposes of safety a rupture diaphragm 18 is provided in the top of housing 16. Although any type of motive means, such as pneumatic or electric motor could be used to power the rams, both cylinders 2 and 2' are preferably powered by a single hydraulic power unit. The two parallel tubes operate in tandem. As the ram in one pelletizing tube moves back, the other moves forward, so that they are always about 180° out of phase. This relationship permits sharing of a common feed hopper, rotating vane and hydraulic power system, which considerably reduces the complexity and cost of the apparatus.

While the pelletizer shown in FIGS. 1 and 2 is in the horizontal position, it could be operated in an inclined or vertical position if this were found to be desirable or convenient. Thus, while hopper 3 as shown in the drawings communicates with tubes 1 and 1' through feed ports 4 and 4' located in the top sides of the tubes' side walls, the hopper could be made so as to communicate with the tubes in the vertical position by placing the discharge ports from the hopper in its side walls. In such case the feed ports to the tubes would be located in the sides of the side walls of the tubes. Under these circumstances, the rotating vane 5 could either be mounted in the base of the hopper, with the axis of its drive shaft placed vertically, or a different directing mechanism could be used to precompact and feed the refuse into the tubes. A side-to-side push type of feeder which would alternately feed one tube and then the other could be used for this purpose.

It should also be noted that while the pelletizer of this invention is preferably used in direct communication with a furnace refuse feed opening, it does not have to be used in such manner. That is, the pellets do not have to be fed directly from the pelletizer into the furnace. It would, for example, be possible to mount the pelletizer on the ground, to transport the pellets either immediately or some time later to the top of a shaft furnace, and then feed the pellets into the furnace through a gas tight feeding mechanism. One of the advantages of the pelletizer of the present invention, however, is that it avoids the need for additional feeding mechanism, since the pelletizer is capable of feeding the compacted refuse pellets directly into the furnace without permitting any gases to escape into the atmosphere from the furnace through the pelletizer.

Figure 3:
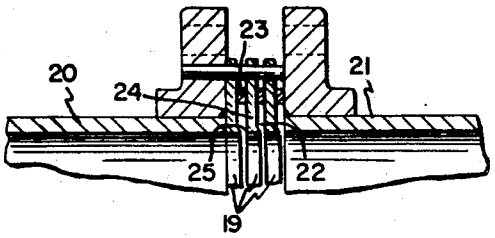
FIG. 3 is an enlargement of the upper portion of the dewatering means used in the apparatus of FIGS. 1 and 2.

FIG. 3 is an enlarged view in cross-section of the upper part of a preferred dewatering means 10 and 11. This consists of three plates 19 located between the flanged ends of two tube sections 20 and 21 bolted together. Plates 19 are each formed on one side only with outwardly flared grooves 22 so that when placed with the grooved side of one plate opposite the flat side of another plate with small spacers 23 between them, a plurality of outwardly flared spaces 24 are formed permitting water to drain through. Drainage means may be provided by any other suitable structure which permits the liquid to escape from inside the tube. However, it is important that there be a sufficient number of ports to permit most of the liquid and air compressed within the refuse by the compaction to be expelled and drained out. In addition, the drainage ports must be constructed in such manner as to flare outward, since this will prevent the ports from becoming plugged by the refuse. A suitable port opening 24' is 1/32" side and flared out to a 3/32" width.

Figure 4:
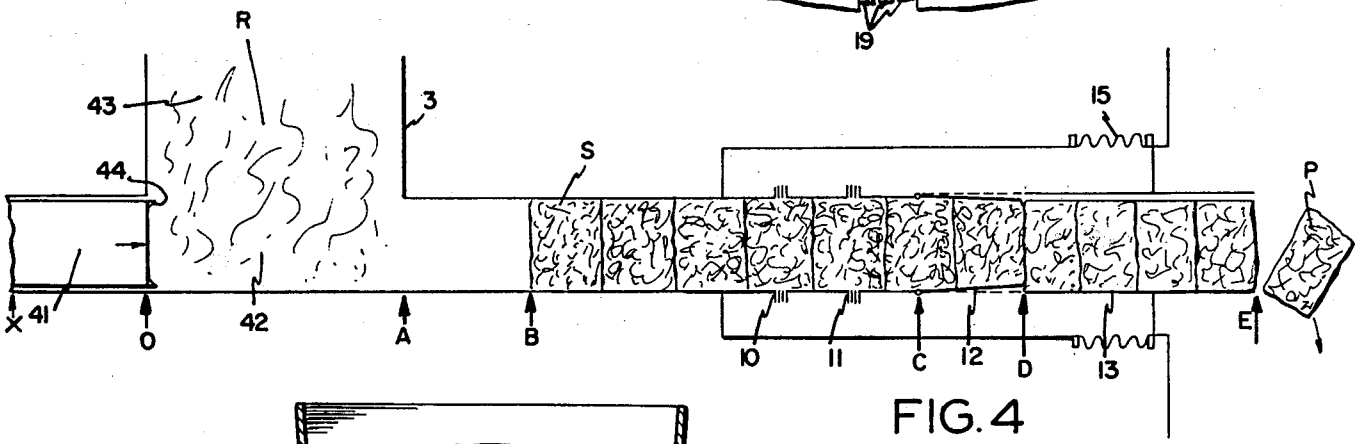
FIG. 4 is a diagrammatic side view illustrating the manner in which the apparatus of the present invention functions to provide a dense pellet of shredded refuse.

FIG. 4 shows diagrammatically how the present apparatus functions to produce the pellets P of shredded refuse. When some loose refuse R is in front of the ram 41 and above the portion swept by the forward stroke of the ram, the vane 5 (shown in FIG. 5) pushes the refuse down into the space 42 swept by the ram. The vane holds the shredded refuse within the tube space 42 during the time the ram travels through the portion between points O and A of the tube beneath hopper 3. As the ram continues moving to the right, all of the material in the volume between points A and B becomes confined, and the further the ram travels to the right the more the refuse in the tube becomes compressed. When the newly compacted refuse is pressed hard enough against an existing slag S of compacted refuse to the right of it, the entire column of compacted refuse will move to the right. The force required to move this material is determined by wall friction and by the action of the restrictors 12 in the tube section between points C and D. The sum of the friction produced by the wall and the restrictors determine the compaction pressure the ram will exert on the refuse newly added into the tube.

The column of refuse that moves to the right consists of the above mentioned confined material in the tube between points B and D, as well as the material fitting loosely in the discharge conduit 13 between points D and E. The dense pellet P which comes out the end of the conduit at point E will fall into the furnace. Although the compaction process produces considerable cohesion within the mass of refuse that constitutes one single stroke of the ram, i.e. one slug, there is very little bonding between successive slugs or the resultant pellets. Thus, as the material is discharged from conduit 13 at point E, it readily breaks off at the interface boundaries between each pellet. Hence, once steady state operation is reached, each stroke of the ram will produce on the average one pellet of compacted refuse discharged from the tube. It is to be understood that the term "slug" as used herein is intended to mean the mass of refuse squeezed together by one stroke of the ram. As the slugs are moved down the tube over a finite period of time under sustained pressure and dewatered they become more coherent, emerging at the end of the tube as strong "pellets."

As noted before, compaction of each new slug of refuse is achieved by squeezing it between the ram and the previously compacted slug downstream. The compaction pressure is the pressure required to move the column of compacted refuse (slugs and pellets) down the tube. In order the control this pressure it becomes necessary to maintain the amount of resistance to motion within a desired range. It has been found that for a given compaction pressure, increasing the length of the column of compacted refuse increases the pressure required to push the refuse down the tube. It has also been found that for a given length of the column of compacted refuse, increasing the compaction pressure increases the force required to push said column down the tube. These two factors lead to the existence of what may be designated as a "critical length" of compacted refuse. That is, the length of compacted refuse slugs in the compacted chamber (section B–D) of the tube, for which the pressure required to move said compacted refuse is just equal to the pressure used to form the slugs. The "critical length," however, is not constant, since it is a function of the refuse characteristics, being shorter for dry refuse than for wet refuse. Also, it is generally shorter for tubes with a smaller diameter than for tubes with a large diameter.

The effect of the phenomenon referred to above may be illustrated by considering a pelletizer operating at the desired compaction pressure with a column of compacted refuse which is at its critical length. As long as conditions remain constant, the refuse will continue to be compressed to the desired pressure; that is, the pressure required to just move the column of compacted refuse down the tube. However, this condition is unstable since it will be upset by very slight variations in operating conditions. For example, if the refuse becomes drier, increasing the wall friction, it will increase the compaction pressure on the next slug formed. This will, in turn, further increase the force required to move the column, because higher compaction pressure causes higher wall friction, and hence further increase the compaction pressure on the following slug formed. This chain reaction of increasing compaction pressure will continue until the compaction capacity of the apparatus is reached, when it will become jammed. The increased wall friction noted above has the effect of decreasing the critical length. The actual length was then greater than the critical length. The reverse situation will occur if the refuse being fed becomes slightly wetter, resulting in progressively dropping compaction pressure until coherent pellets cease to be formed.

The prior art has attempted to solve these problems by providing additional resistance to motion, over and above that provided by wall friction by placing fixed restrictors in the tube at or near its discharge end. Such restrictors have consisted of one or more objects protruding into the tube, or of a reduction in tube diameter at the discharge end. However, from a control point of view, such restrictors are simply equivalent to additional tube length, and consequently, do not solve the problem, since the same unstable compacting condition as described above still exists.

It has been discovered that in order to provide apparatus which will operate stably on material which varies almost constantly in composition or moisture content, it is necessary, if operating with a constant ram stroke, to make the length of the compacted chamber of the tube (B–D in FIG. 4 if the restrictors open only to the size of the tube and B–C in case the restrictors can open sufficiently wider than the tube diameter so that they offer very little resistance to pellet motion) shorter than the shortest "critical length" for the material to be pelletized, and to provide variable resistance to the flow through the tube with adjustable restrictors which are responsive to changing conditions, so as to remain within the desired range of compaction pressure. The "critical length" must be determined experimentally for the particular material being compacted.

The term "tube" is used throughout the present specification and claims in a generic sense to include the entire cylindrical barrel, i.e., the length X–E in FIG. 4.

However, it should be noted that the tube has six distinct functional sections. These are best seen in FIG. 4. Section X–O is the ram housing, section O–A is the feed section, section A–B is the compacting section, B–C is the compacted section, C–D is the restrictor section, and D–E is the (wider) conduit section. Sections B–C plus C–D, i.e. B–D constitutes the compacted chamber of the tube. It is this chamber or section (B–D) which has the "critical length" discussed above. The practical effect of the "critical length" is that if the compacted chamber is made longer than the shortest "critical length" for the refuse being compacted, it will become jammed. In such case, the refuse will not come out the discharge end of the tube regardless of the pressure applied, since increasing the pressure will only jam the refuse into the tube harder.

The apparatus described above has been designed especially for pelletizing shredded municipal refuse. It has been found that in such material the shortest "critical length" for a tube with an inside diameter of 13" is about 5½ ft. This is the length of the tube containing the compacted refuse, i.e. from the point just beyond the end of the ram stroke to the discharge end of the restrictor assembly (equivalent to the distance B–D in FIG. 4). For similar municipal refuse it has been found that for a tube having a 4" inside diameter, the shortest "critical length" is about 19". Hence, it appears that for shredded municipal refuse the ratio of the shortest "critical length" to the inside diameter of the tube is approximately 5:1. For the above two cases, the ratios are 5:1:1 and 4:75:1, respectively.

It has been found that the density of shredded refuse varies depending upon the composition of the refuse, its moisture content, and the degree to which the refuse has been shredded. The density of the pellets depends upon the same parameters as the shredded refuse from which it is made, as well as on the compaction pressure and on the length of time for which the compaction pressure is applied to the pellet. For ordinary municipal refuse, with most of the ferrous metal removed, the average density of shredded municipal refuse is about 4 lbs. per cu. ft. A typical pellet useful in the Anderson process has an average density of about 40 lbs. per cu. ft. as it is formed in the pelletizer. Consequently, the pelletizing apparatus must be able to produce, on the average, a ten fold densification of the refuse.

It has been found preferable to produce pellets with lengths approximating the diameter of the pellet. The useful range of pellet lengths, however, is from about ⅓ the pellet diameter to about 1.5 times the pellet diameter. If shredded refuse at a density of 4#/cu.ft. is put into the tube space between points O–A in FIG. 4, transferred at this density into the enclosed space A–B, and then compressed to a density of 40#/cu.ft. to make a slug one diameter long, both lengths O–A and A–B must be 10 diameters long, and the ram stroke must then be 20 diameters long. Such a long ram stroke is impractical and inefficient. It has been found that these lengths can be reduced considerably by slightly pre-compressing the refuse into the volume in front of the ram and preventing it from being pushed upward and out of the tube as the ram moves to the right. This is preferably accomplished by a vane 5 as shown on FIG. 5.

Figure 5:
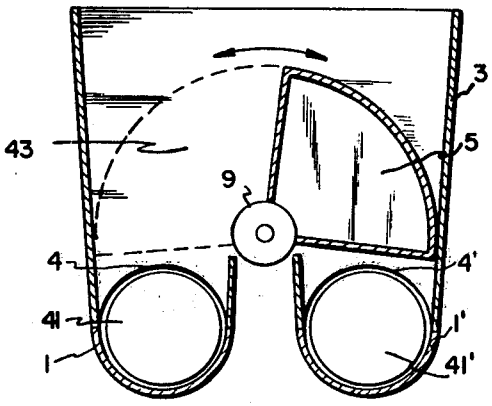
FIG. 5 is a front view in cross-section taken along line 5—5 in FIG. 1 illustrating operation of the vane.

FIG. 5 discloses tubes 1 and 1' communicating with a common hopper 3 through feed ports 4 and 4' located in the top of the tubes' side walls. Vane 5 is caused to reciprocate from left to right as indicated by the arrow through drive shaft 9. When vane 5 is in the right hand position, refuse is directed to fall into tube 1. Thereafter vane 5 swings to the left, thereby directing the refuse into tube 1' and slightly compressing or precompacting the refuse by pushing it down into the tube. Vane 5 remains in this position to keep tube 1 closed while the ram 41 travels forward through the portion of the tube (O–A in FIG. 4) containing the feed port 4. If vane 5 were not to keep the feed port 4 closed in tube 1, the refuse would tend to be pushed back up into hopper 3 when the ram 41 began to move forward. Vane 5 functions in timed sequence with the reciprocating rams such that the tube feed ports remain closed by the vane as the rams move forward and are open while the ram is in its retracted position, thus permitting refuse to fill the space 42 in the tube in front of the ram. Vane 5 serves still another function, namely to percompact the refuse. Since loose refuse fills space 43 in hopper 3 above the feed ports, most of the refuse in space 43 will be pushed down into space 42 as the vane closes, thereby increasing the quantity and consequently the density of the refuse in space 42. The effect of this precompacting is to increase the amount of refuse which will be compacted by each stroke of the ram, thus increasing the compacting efficiency and capacity of the pelletizer. Refuse that hangs partially in and partially out of the zone swept by the ram should be sheared when the ram passes position A of FIG. 4 to keep it from being wedged between the ram and the tube. This is made easier by securing a set of cutting teeth 44 around the entire periphery of the rams 41 and 41'.

Figure 9:
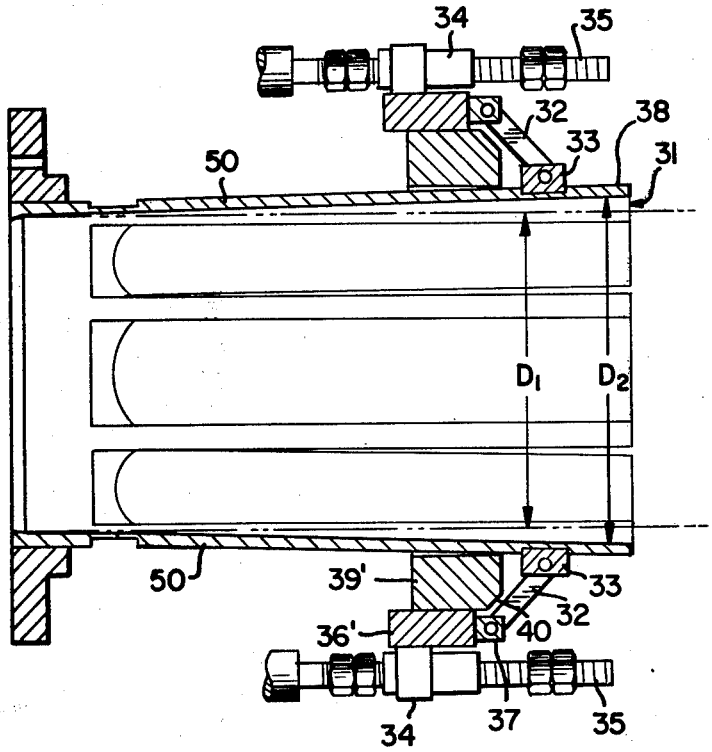
FIG. 9 illustrates a modification of the restrictor assembly shown in FIG. 6, wherein the restrictor leaves are capable of being opened to produce an outwardly flared cone.

In order to provide coherent pellets, the pelletizer requires restrictors which act without breaking up the pellets. This can be accomplished by constructing the restrictors so that they form a smooth continuation of the inner surface of the tube; for example, from a cylinder to a smooth gradually tapered truncated cone. In addition, the degree of restriction produced by the restrictors must be variable and rapidly responsive to changes in compaction pressure so as to keep the compaction pressure within the desired preset range. To achieve these results, the preset restrictors are controlled such that if the ram pressure required to push the column of compressed refuse through the tube is greater than a predetermined pressure, the restrictors are caused to open slightly; while if the ram pressure is less than a lower predetermined pressure, the restrictors are caused to close down slightly. If the ram pressure is within the preset range, no change is made in the position of the restrictors. Adjustment of the restrictors may be made automatically and by power driven means. The restrictors are also made such that in their fully open position they form an outward flared cone as illustrated in FIG. 9. This is an important characteristic of the present invention, since in this position the restrictors cause less frictional resistance to the flow of refuse than does a straight tube of equal length.

Figure 7:
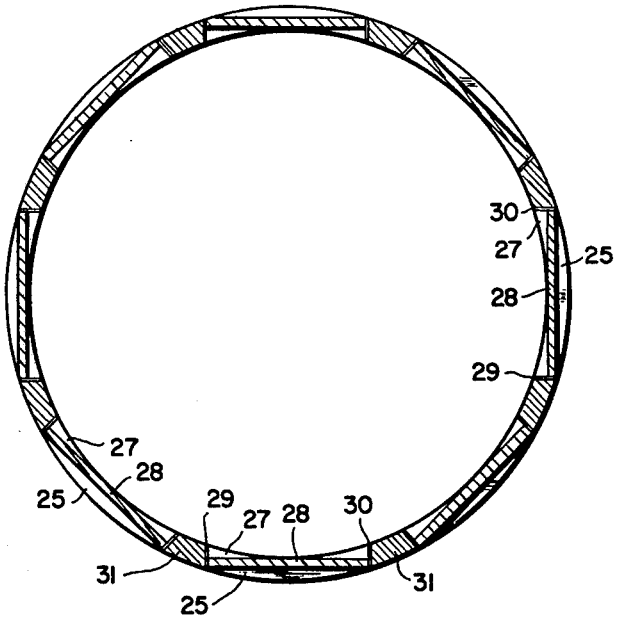
FIG. 7 is a cross-section of the restrictor assembly shown in FIG. 6 taken along line 7—7.
Figure 6:
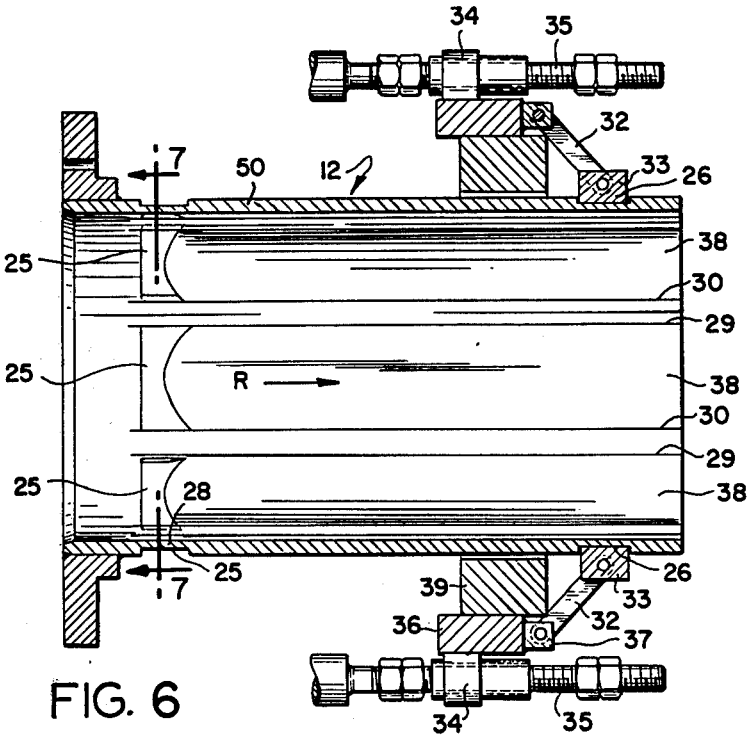
FIG. 6 is an enlarged longitudinal view in partial cross-section illustrating the restrictor assembly shown in FIG. 1.

FIGS. 6 and 7 show the preferred structure of the restrictor assembly of the present invention. The restrictor assembly 12 is made up of a two ft. length of the tube 1, which has an inside diameter of thirteen inches. The restrictor assembly 12 consists of eight movable restrictor leaves 38 which function together to comprise the restrictor means. Each leaf 38 has been cut from a section 50 of tube 1 so that it forms a smooth continuation of the inside tube wall. Hinges for the leaves 38 may be made by milling eight grooves 25 around the outside surface of tube section 50. A like number of grooves 27 are machined around the inside surface of the steel tube opposite slots 25 so that the grooves are parallel to each other, leaving only a thin flexible section 28 of the original tube thickness between grooves 25 and 27. The resultant structure can be seen more clearly in FIG. 7, which is a cross-section taken along line 7—7 of FIG. 6. A plurality of parallel cuts 29 and 30 are made axially through tube section 50 down to the end of the flexible section 28, thereby producing the leaves 38. Since the thin sections 28 are flexible, the leaves are free to be moved radially inward or outward by exerting a force on their downstream ends. It is important that each pair of cuts 29 and 30, and consequently each pair of edges of leaves 38, be parallel to each other. This is necessary because as the downstream end of a leaf 38 moves in or out, the clearance between each leaf and the stationary portions 31 left between each of the leaves does not change. This constant clearance avoids packing of refuse and consequent jamming which would result if radial cuts were made. It can be seen from FIG. 7 that by making eight leaves 38 from the tube section 50, will leave eight truncated cone shaped sections 31 between the leaves. These sections 31 remain an integral part of the tube section 50.

The construction described above is preferred; however, it will be apparent to those skilled in the art that the restrictor assembly 12 could be modified either in design or method of fabrication without departing from the basic concepts of the present invention. For example, the leaves 38 can be fabricated from metal other than from the tube section itself, and these could be attached at the lower end to the tube by mechanical hinges instead of the flexible steel section 28.

Figure 10:
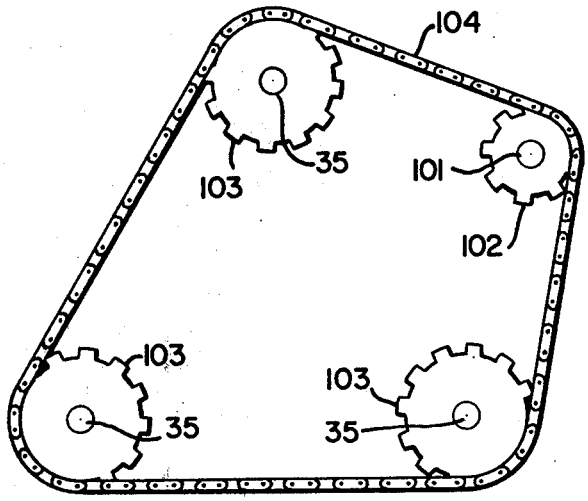
FIG. 10 illustrates a preferred structure for obtaining uniform movement of the restrictor leaves by utilizing a common drive means.

The manner in which leaves 38 are moved in or out can best be seen by reference to FIG. 6. A set of eight blocks 33 are each fixedly attached to the downstream end of each leaf 38 at the eight grooves 26 which have been cut into each leaf. A pair of links 32 (only one is seen) are pivotally attached to each side of each block 33 at one end and to a ring 36, through blocks 37 fixedly attached to ring 36, at their other end. Ring 36 is in sliding contact with ring 39 which is fixedly attached to the stationary sections 31 between the leaves. Spacers (not shown) may be used in between ring 39 and the fixed members 31 in order to make it possible for the leaves to be movable in the radially outward direction. Ring 36 is also fixedly attached at three equally spaced locations around its outer circumference to three nuts 34 (only two are seen) which are threaded on the inside. Threaded rods 35 engage the inside threads of each nut 34. Rods 35 while rotatable in place by a drive means (not shown), are attached so as to be unable to move from left to right. Consequently, rotation of rods 35 will cause ring 36 to be moved from left to right in FIG. 6. The three rods 35 are geared together as shown in FIG. 10 and commonly driven in order to insure that ring 36 always remains in a plane perpendicular to the axis of the tube 50. As ring 36 is caused to move toward the right, it will exert a force through links 32 upon each of the blocks 33 and hence upon each leaf 38, causing the leaves to be moved radially inward. By reversing the direction of rotation of rods 35, ring 36 will be pulled toward the left and leaves 38 will consequently be pulled radially outward. Ring 36 is keyed (not shown) to stationary ring 39 in order to prevent it from rotating relative to tube section 50, thereby insuring that blocks 33 and 37 and hence links 32 remain in proper alignment.

FIG. 9 illustrates a modification of the restrictor assembly shown in FIG. 6 by which the restrictor leaves 38 are enabled to be opened wider than the inside diameter $D_1$ of the tube 50. This modification enables the restrictor to have an outwardly flared cone shape. The restrictor leaves 38 can be pulled open to a diameter $D_2$ which is greater than $D_1$ by moving ring 36' to the left as in FIG. 6. This is accomplished by making the ring 39' greater in inside diameter than ring 39 of FIG. 6. Rings 36' and 39' are in sliding contact. Ring 39' is fixedly attached to the stationary members 31 (see FIG. 7) with spacers (not shown) therebetween to accommodate the larger ring 39'. Ring 39' has slots 40 cut into it to prevent interference between ring 39' and links 32 when ring 36' is moved to the left.

FIG. 10 illustrates a preferred structure for obtaining uniform movement of the restrictor leaves by utilizing a common drive means. As noted with respect to FIG. 6, the three threaded rods 35 are geared together to a common drive. This may be accomplished by providing a driven shaft 101 with a sprocket wheel 102. Each of the rods 32 is also provided with a sprocket wheel 103, and all are linked together by a common sprocket chain 104. Hence, the drive means 101 is used to rotate all three rods 35 at a uniform speed. This in turn causes ring 36 to remain in a plane perpendicular to the axis of tube 50 as previously described.

A preferred automatic system for controlling the restrictors in response to changes in the ram pressure required to advance the compacted refuse down the tube, is described and claimed in my copending U.S. application Ser. No. 690,281 filed May 26, 1976, the entire disclosure of which is incorporated herein by reference. The preferred system for controlling the restrictors described therein more fully may be illustrated by reference to FIGS. 11 and 12. The restrictor leaves may be adjusted after each compaction stroke in accordance with the compaction pressure measured during that stroke. If the compaction pressure is less than some predetermined value $P_1$ then the restrictors will be adjusted in (or closed) a predetermined increment. If the pressure is above some predetermined higher pressure $P_2$, then the restrictor leaves will be adjusted out a predetermined increment. If the pressure is between $P_1$ and $P_2$, no adjustment will be made. If the compacting rams are driven by hydraulic cylinders, the hydraulic pressure delivered to the cylinder (i.e. the ram pressure) can be translated into compaction pressure by multiplying the hydraulic pressure by the ratio of the area of the hydraulic cylinder piston to the area of the ram face. The hydraulic and mechanical frictional forces and the force required to push back the retracting ram must be accounted for to get an accurate figure. However, for practical purposes these will be reasonably constant so that hydraulic pressure monitoring alone will serve the purpose.

Curve I in FIG. 11 shows the hydraulic or ram pressure as a function of ram position when a full load of shredded refuse is being compacted. The pressure up to point Z is that just required to overcome fluid plus mechanical friction and to push the other ram back. The pressure starts to rise at point Z as refuse is encountered by the ram and beginning to be compacted. At point M the force against the compacted material in the tube is enough to move the column of refuse in the tube; and from point M to point B, the forward end of ram travel, the pressure is fairly constant. At the end of the travel, point B, the hydraulic pressure drops rapidly in preparation for reversal. The dotted portion of the curve from M to N represents a pressure spike that sometimes occurs just before the column of refuse in the tube starts to move. This occurs, for example, when the refuse contains a large amount of dry papers, and it represents a condition where the static friction of the refuse is greater than the dynamic friction.

For the purpose of determining restrictor adjustment, it would be satisfactory to monitor the pressure at any ram position from points N to B, or from points M to B if there were no pressure spike. However, if there is only a small amount of refuse being compacted, the pressure curve will look like Curve II in FIG. 11. In this case it is not satisfactory to check for a low pressure, i.e. below $P_1$ until after point M' has been reached. Hence, it has been found desirable to measure the pressure for the purpose of determining if it is below $P_1$ as late in the stroke as possible. Preferably, this pressure monitoring starts at point Y, which may be about one inch from the forward end of the ram stroke, and stops at point B when the forward end of the ram travel is reached, but before the hydraulic pressure drops down in preparation for reversal.

There may be occasions when there is no refuse at all in the compaction zone. In such case the pressure curve will look like Curve III in FIG. 11. The reason the pressure rises near the end of the stroke in this case is that the refuse compacted on the previous stroke springs back a little when the ram is retracted, and this refuse is recompressed on each successive ram stroke. It can be seen that the pressure at point Y where pressure monitoring for $P_1$ starts is far below what it would have been (as shown by Curves I and II) had refuse been fed into the tubes. This would cause a signal to adjust the restrictors "in", when in fact, no adjustment should be made. To take this situation into account, as well as very small loads that might give pressure curves between Curves II and III, the pressure should be monitored at a second point X which may be about 6 inches from the forward end of the ram stroke. The control system is then designed so that if the pressure at point X is not above some predetermined pressure $P_3$, which is lower than $P_1$, no subsequent "in" adjustment will be made during that cycle, no matter what the pressure is after the ram is past point X.

The location of point X (the lock-out point) and the value of $P_3$ (the lock-out pressure) must be determined for each application according to its requirements. The point represented by the intersection of a vertical line through X and a horizontal line through $P_3$ on FIG. 11 must lie in the shaded area between Curves IIa and IIIa and as close as possible to Curve IIa. Curve IIa represents the smallest increment of feed and the lowest compaction pressure for which an "in" adjustment will be made. Completely automatic operation is obtained over the widest range of conditions if the dotted extension of Curve IIa (where the pressure trace would have gone if there had been enough restriction) would reach a pressure of $P_1$ a little before the ram reaches position Y and if $P_4$ is the lowest compaction pressure consistent with having a practicable operating zone between the Curves IIa and IIIa. The Curve IIIa represents the pressure trace of the no-feed stroke following a maximum spring-back condition. With municipal refuse this maximum spring-back condition probably occurs when the refuse is all dry paper or cardboard and the compacter is operating at its maximum compaction pressure.

It is also necessary to monitor excessive pressure, i.e. pressure greater than $P_2$ to initiate an "out" adjustment of the restrictors. This, however, is not as critical as the above, and can be done at any point after the ram has passed point A in FIG. 4, which corresponds approximately to point Z in FIG. 11. The pressure $P_2$ may be monitored for a possible "out" adjustment during the interval that the ram travels from X to B in FIG. 11 or it may be monitored from Y to B as in the case of $P_1$. This later monitoring avoids most undesirable adjustments that might be caused by the pressure spikes as shown by the dotted lines between M and N. Normal pressure settings for $P_1$, $P_2$ and $P_3$ for making good pellets from municipal refuse are about 500 psi, 800 psi and 200 psi, respectively.

An electrical circuit which may be used to accomplish the above described control function is shown schematically in FIG. 12. For purposes of simplicity the following symbols are used to describe the circuit shown in FIG. 12.

ILS — Limit switch closed from ram position A to full retract - (O).
2LS — Limit switch opens at full forward only.
3LS — Limit switch closed from ram position X to full forward (B).
4LS — Limit switch closed from ram position Y to full forward (B).
1PS — Pressure switch set to open at $P_1$.
2PS — Pressure switch set to close at $P_2$.
3PS — Pressure switch set to open at $P_3$.
CR — Control Relay
TR — Time Delay Relay
MF & MR — Coils of magnetic starter that operates forward (MF) and reverse (MR) drive of motor that adjusts restrictor.

Operation of the circuit is as follows. The numbers in parenthesis following the symbols refer to the line numbers in FIG. 12.

A ram, prior to reaching position A as it moves forward permits relay 1CR (1) to be energized by 1LS (1) and sealed in by 2LS and 1CR-2(2). Contact 1CR-1 (3) closes and sets up for pressure monitoring as the ram proceeds. Switch 3LS (3) closes at ram position X which is about 6 inches before the end of the ram travel. If the pressure at this point (or any time up to the end of ram travel) is over $P_2$, timer 2TR will be energized through the closed contact of 2PS (6). Contact 2TR-2 (8) closes instantly to operate magnetic starter coil MR (8) which runs the drive motor (not shown) to open the restrictors. When the ram opens the forward limit 2LS (2) the circuit is opened by 1CR (1). Relay 1CR will remain de-energized since 1LS (1) is open during the ram position from ram position A to full forward. Contact 1CR-1 (3) now opens and drops out 2TR. After a delay 2TR-2 (8) opens and stops the restrictor drive. Going back to the point above where 3LS (3) has just closed at ram position X, if the pressure is over $P_3$ pressure switch 3PS (4) will be open and 2CR will not be energized. Switch 4LS (3) closes at ram position Y completing the circuit to 1PS through the still closed contacts of 2CR-1 (3). If the pressure is now below $P_1$ 1PS (3) will be closed and 1TR will be energized. This closes the restrictor by the same sequence of events detailed above for opening it. If the pressure remains above $P_1$ during the interval between closing of 4LS (3) and the end of ram travel (which opens 1CR-1 (3)), no restrictor "close" adjustment is made. Going back again to the point above where 3LS (3) had just closed at ram position X, if the pressure is less than $P_3$ the pressure switch 3PS (4) will be closed and 2CR (4) will be energized and sealed in by 2CR-2 (5). Contact 2CR (3) will open and remain open during the remainder of ram forward travel. This will prevent any energizing of 1TR regardless of the pressures that occur. This is to prevent restrictor closing when there is no feed.

Note that the pressure monitoring circuits (3 to 6) are effective in the forward motion of the ram only as it passes through the gate from ram position X to end of travel, hence false pressure signals at other times will have no effect. Note also that instant (not timed) contacts of 2TR-1 (3) and 1TR-1 (6) prevent simultaneous energizing of both time relays. If there is a pressure cycle that would operate both relays, only the one in the circuit energized first would actually operate.

Figure 8:
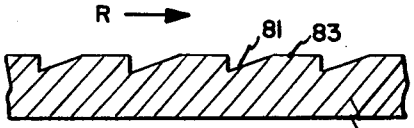
FIG. 8 is a cross-section of the tube having circumferential cuts which can be made in the inside surface of the tube to reduce friction.

As pointed out above, it is desirable to have the column of compacted refuse as long as possible in order to obtain the longest possible residence time, and hence stronger pellets. Since it is not possible to increase this length arbitrarily beyond the critical length, as previously defined, because the pelletizer will then become jammed, one way of increasing the actual length of the tube without increasing friction, is to cut circumferential grooves into the inner surface of the tube. FIG. 8 shows a longitudinal cross-section of a piece of tube 82 into which a plurality of slanted cuts 81 have been made on the inside surface. The arrow indicates the direction of refuse flow. Cuts 81 may be spaced about $\frac{3}{8}$" apart, thereby leaving $\frac{3}{8}$" long flat surfaces 83 on the inside of the tube. Each of the cuts 81 is about $\frac{1}{8}$" deep at its deepest point. The refuse pellets are sufficiently solid so that they bridge most of the grooves 81 and bear mostly on the flat surfaces 83, i.e. the ungrooved surface. This reduction in bearing area per unit length of tube reduces the total frictional force per unit length of tube. While it might be assumed that the increased unit loading on the ungrooved surface would just counteract the decreased area, experiments have shown that this does not occur, and that reduced frictional drag is obtained.

What is claimed is:

1. Apparatus capable of producing pellets of compacted refuse having a density of at least 20 lbs./ft.$^3$ comprising:

(1) a cylindrical tube of uniform diameter comprising a ram housing section, a feed section, a compacting section, a compacted section and a restrictor section, said tube being provided in the feed section with a feed port in its side wall, (2) a feed hopper for the refuse to be compacted having an outlet port communicating with the feed port of said tube, (3) a reciprocating driven ram located in the ram housing section of said tube and axially aligned therewith, the perimeter of said ram being in sliding contact with the inner surface of said tube and capable of exerting a pressure of at least 200 psi on each forward stroke of the ram, and (4) means located in the restrictor section of said tube for variably restricting the flow of refuse in response to changes in the force required to advance the column of compacted refuse in the tube, comprising a plurality of axially elongated leaves located symmetrically around the circumference of said tube and being separated from each other by stationary portions which are an integral part of the tube, the side edge surfaces of each leaf being parallel to each other, each leaf constituting a flush section of the tube wall flexibly attached at its upstream end to the tube and provided at the downstream end with means for positively moving each of said leaves uniformly toward or away from the tube axis.

2. Apparatus as in claim 1, wherein the length of said compacted section is shorter than the shortest critical length for the refuse to be pelletized.

3. Apparatus as in claim 1, comprising two parallel cylindrical tubes whose respective feed ports communicate with a single feed hopper, and wherein the respective rams within each tube operate in tandem such that when one is retracted the other is extended.

4. The apparatus of claim 3, wherein said means for restricting the flow of refuse is controlled on each forward stroke of the ram.

5. Apparatus as in claim 3, additionally comprising means for closing the feed ports, said means constituting a power driven rotating vane, located in the base of the hopper, and operable in timed sequence with each of said reciprocating rams.

6. Apparatus as in claim 5, which additionally comprises means for dewatering the refuse, said means being located in the downstream portion of the tube.

7. Apparatus as in claim 6, rendered capable of feeding said pellets directly into a refuse disposal furnace in a gas tight manner, which additionally comprises a gas tight housing enclosing said means for restricting the flow of refuse said means for dewatering, said housing communicating with a furnace feed port.

8. Apparatus as in claim 7, wherein the inside surface of said tube is provided with a plurality of circumferential depressions to reduce friction between the refuse and the inside surface of said tube.

9. Apparatus as in claim 1, wherein said ram is characterized by having a constant stroke length.

10. The apparatus of claim 1, wherein said restrictor leaves are capable in their fully open position to form an outwardly flared cone.

* * * * *